United States Patent [19]

Sauber

[11] 4,134,500

[45] Jan. 16, 1979

[54] ACTUATOR LINKAGE FOR MOBILE DERRICKS AND THE LIKE

[76] Inventor: Charles J. Sauber, 10 N. Sauber Rd., Virgil, Ill. 60182

[21] Appl. No.: 743,984

[22] Filed: Nov. 22, 1976

[51] Int. Cl.[2] ..... G05S 1/04; B66C 23/06; B66C 23/60

[52] U.S. Cl. ..... 212/59 R; 74/519; 74/522.5; 212/55; 214/143

[58] Field of Search ..... 212/8 R, 8 A, 8 B, 35 R, 212/35 HC, 46 R, 46 A, 46 B, 58 R, 58 A, 59 R, 59 A, 55–55, 39 MS; 92/84, 85 A, 724, 725, 683, 688; 74/519–520, 522.5; 298/22 R, 22 A, 22 P, 22 D; 267/20; 214/660, 670–674, 143, 77

[56] References Cited

U.S. PATENT DOCUMENTS

| | | | |
|---|---|---|---|
| 1,172,255 | 2/1916 | Buck | 92/85 A X |
| 2,136,663 | 11/1938 | Anthony | 298/22 R |
| 2,635,004 | 4/1953 | Shadwick | 298/22 D |

FOREIGN PATENT DOCUMENTS

| | | | |
|---|---|---|---|
| 2029998 | 12/1970 | Fed. Rep. of Germany | 212/35 |
| 1182070 | 2/1970 | United Kingdom | 212/8 R |
| 1261804 | 1/1972 | United Kingdom | 22/39 MS |

*Primary Examiner*—Francis S. Husar
*Assistant Examiner*—R. B. Johnson
*Attorney, Agent, or Firm*—Leydig, Voit, Osann, Mayer & Holt, Ltd.

[57] ABSTRACT

A mobile derrick, aerial man lift or the like has a boom pivotally mounted at one end on a vehicle, with a hydraulic cylinder also pivotally mounted at one end on the vehicle for raising and lowering the boom. A linkage interconnects the other end of the hydraulic actuator with the boom while permitting limited relative movement between the interconnected points of the boom and the actuator. A resilient biasing means such as a compressed coil spring is connected to the linkage and resists downward movement of the actuator away from the boom. The linkage is responsive to upward movement of the actuator to form a rigid connection between the boom and the actuator and bypassing the biasing means, and is responsive to downward movement of the actuator to form a resilient connection between the boom and the actuator through the biasing means to permit limited downward movement of the actuator away from the boom against the urging of the resilient biasing means. The resilient connection protects the hydraulic actuator from the strains produced by abrupt forces, due to bending of the vehicle frame or the abutment of the boom against the ground or other rigid objects, for example.

11 Claims, 5 Drawing Figures

ACTUATOR LINKAGE FOR MOBILE DERRICKS AND THE LIKE

DESCRIPTION OF THE INVENTION

The present invention relates generally to mobile derricks, aerial man lifts and the like and, more particularly, to an improved linkage for the actuator in mobile derricks and the like having a boom pivotably mounted on a vehicle.

It is a principal object of the present invention to provide an improved actuator linkage for mobile derricks and the like which reduces the strains on the actuator due to flexing of the vehicle frame or sudden contacts of the boom with the ground or other rigid objects. In this connection, a related object of the invention is to provide such a linkage which extends the operating life of the actuator and reduces maintenance problems.

It is another object of the invention to provide such an improved actuator linkage for mobile derricks and the like which reduces strains on the structural elements of the derrick.

A further important object of one specific embodiment of the invention is to provide an improved actuator linkage for mobile derricks and the like which reduces the strain on the derrick boom due to sinking or downward movement of a boom saddle or rigid support between the actuator and the free end of the boom.

Still another object of the invention is to provide such an improved actuator linkage which is simple and economical to manufacture with a rugged construction that has a long operating life.

Others objects and advantages of the invention will be apparent from the following detailed description and the accompanying drawings, in which.

Figures 1, 2, 3:
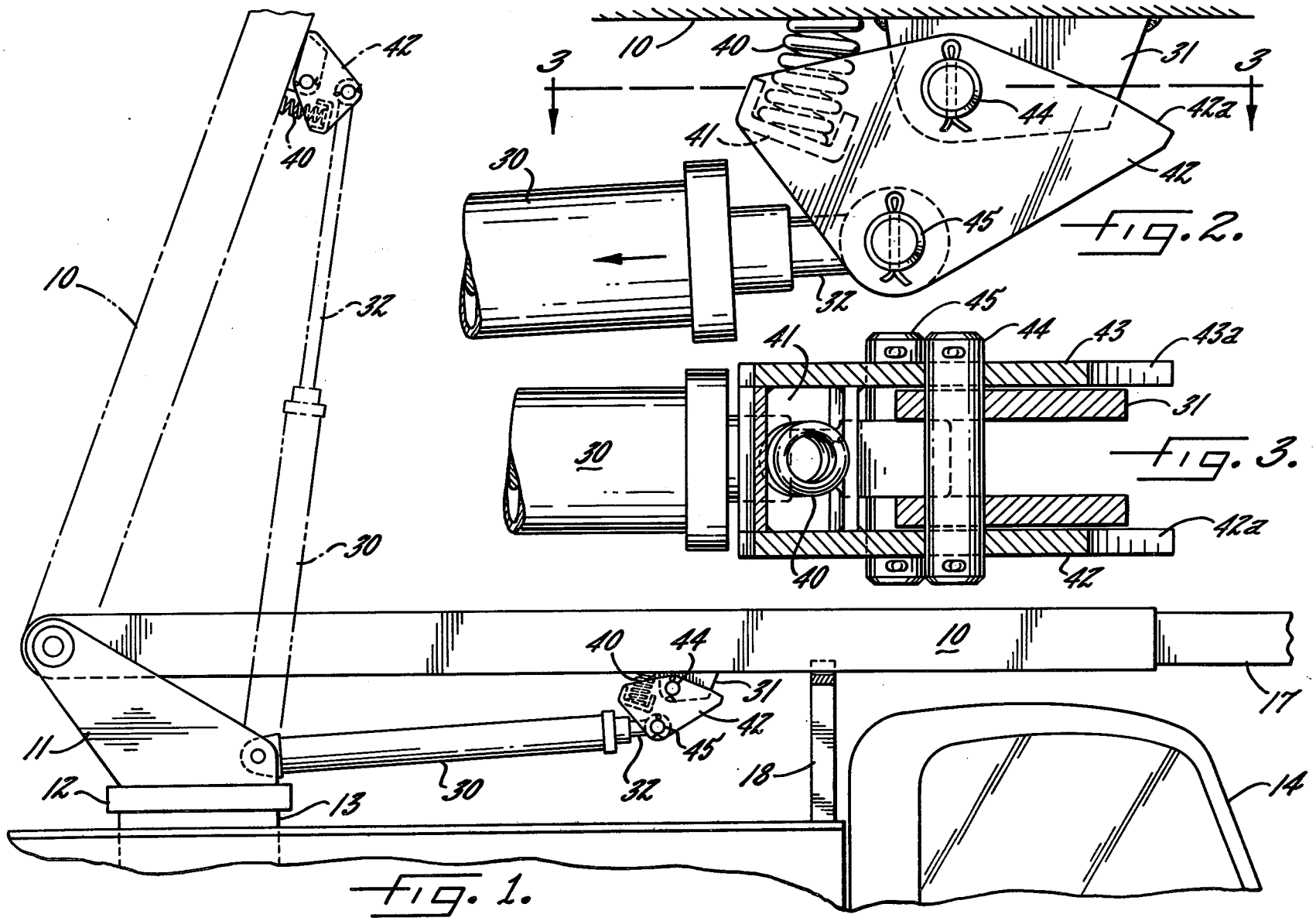
FIG. 1 is a partial side elevation of a hydraulically actuated derrick mounted on a truck or vehicle and showing a derrick in its lowered position ready for transport, and with a raised position of the derrick shown in broken lines.
FIG. 2 is an enlarged side elevation of the linkage between the movable end of the actuator and the boom, embodying the present invention.
FIG. 3 is a section taken substantially along line 3—3 in FIG. 2.
Figures 4, 5:
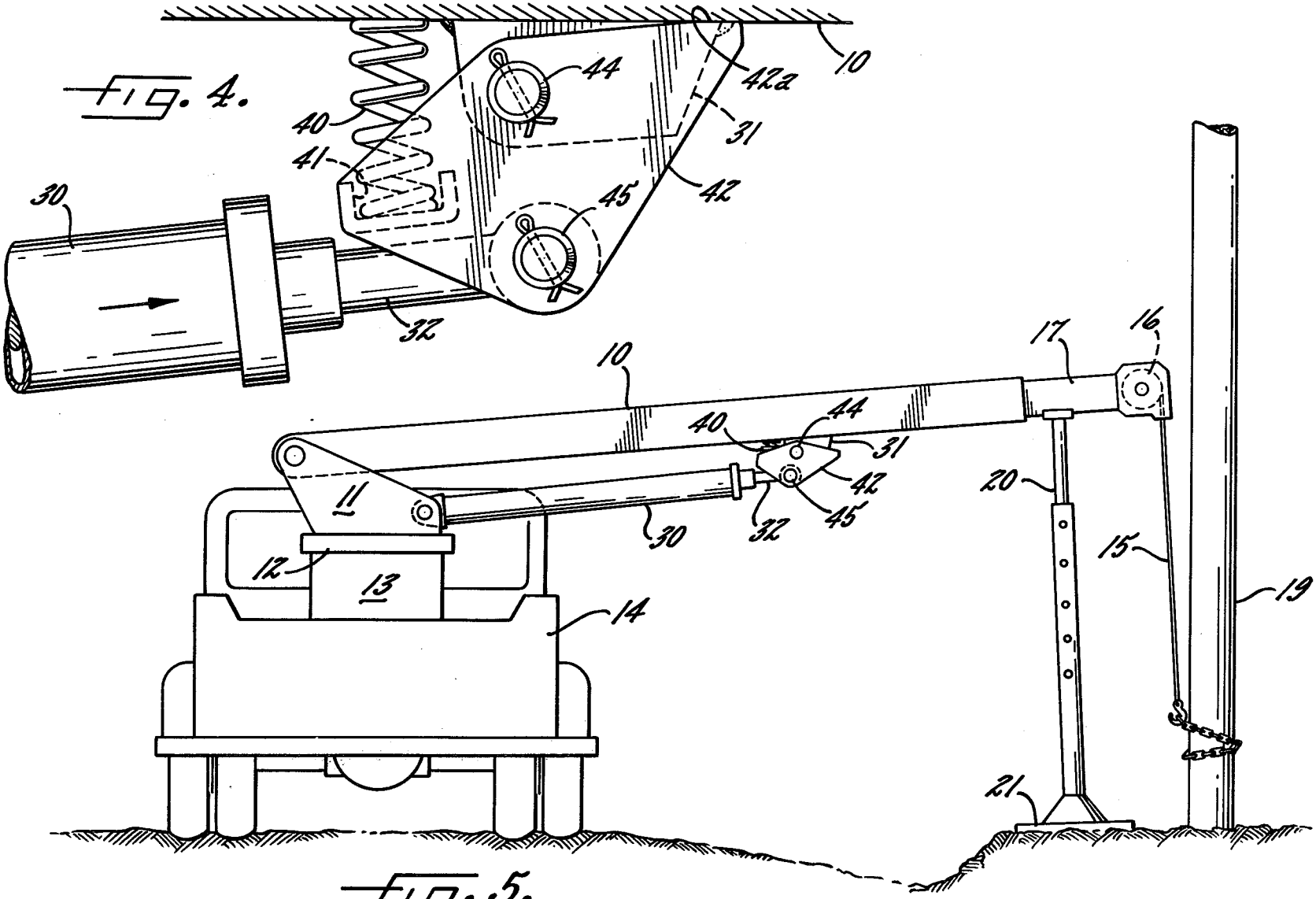

FIG. 4 is the same enlarged side elevation shown in FIG. 3, but with the linkage in a different position, i.e., the position assumed by the linkage during advancing movement of the actuator to raise the boom; and FIG. 5 is an end elevation taken from the rear of the truck shown in FIG. 1 and with the boom extended laterally away from the truck and resting on a rigid ground support for extracting a pole from the ground.

While the invention will be described in connection with certain preferred embodiments, it will be understood that it is not intended to limit the invention to those particular embodiments. On the contrary, it is intended to cover all alternatives, modifications and equivalents as may be included within the spirit and scope of the invention as defined by the appended claims.

Turning now to the drawings and referring first to FIGS. 1 and 5, there is shown a mobile derrick comprising a boom 10 pivotally mounted on a clevis frame 11 mounted for rotation on a turntable 12. The turntable 12 is carried on a pedestal 13 secured to the frame of a truck or vehicle 14 which may be equipped with outriggers (not shown) for stabilizing the truck when the derrick is in use. The boom 10 is equipped with a power winch controlling a cable 15 extending over a sheave 16 journalled on a telescoping extension 17 on the end of the boom. During transport of the derrick from one site to another, the boom 10 is normally carried in the position shown in FIG. 1, resting on a rigid saddle 18 at the front of the truck bed. In FIG. 5, the boom is shown in a nearly horizontal position for extracting a pole 19 from the ground, with the boom extension 17 supported by a ground support or stiff leg 20 extending upwardly from a ground shoe or pad 21.

For the purpose of raising and lowering the boom 10, a hydraulic actuator 30 is pivotally connected between the clevis frame 11 and a bracket 31 secured to the underside of the boom 10. To raise the boom, the piston of the actuator 30 is advanced to extend the length of the actuator and thereby pivot the boom upwardly about the axis of its pivotable connection to the clevis frame 11. Conversely, the piston of the actuator 30 is retracted to shorten the actuator during lowering movement of the boom.

During normal usage of the boom 10, the hydraulic actuator 30 is subjected to a variety of sudden changes in its loads. For example, the truck frame is normally designed to permit a certain amount of flexing, and this flexing subjects the derrick, and particularly the hydraulic actuator, to severe strains. Similarly, when the end of the boom strikes the ground or other rigid objects, the boom is suddenly halted, causing an abrupt change in the hydraulic pressures within the actuator and the associated hydraulic lines and valves. These sudden load changes not only affect the operating life and maintenance requirements of the hydraulic actuator, but also produce strains in the structural elements of the derrick.

In accordance with one important aspect of the present invention, the linkage between the hydraulic actuator and the boom includes resilient biasing means connected to the linkage and resisting downward movement of the actuator away from the boom, and the linkage is responsive to upward movement of the actuator to form a rigid connection between the boom and the actuator and bypassing the biasing means, and is responsive to downward movement of the actuator to form a resilient connection between the boom and the actuator through the biasing means to permit limited downward movement of the actuator away from the boom against the urging of the resilient biasing means. Thus, in the illustrative embodiment, a compressed coil spring 40 associated with the linkage between the piston rod 32 and the boom bracket 31 resists downward movement of the piston rod 32 away from the boom bracket 31. The spring 40 is compressed between the underside of the boom 10 and a transverse base plate 41 connected between a pair of spaced side plates 43 and 43 which are pivotally connected to both the piston rod 32 and the boom bracket 31. More specifically, an upper pin 44 connects the two side plates 42 and 43 to the boom bracket 31, while a lower pin 45 connects the plates 42 and 43 to the piston rod 32.

As can be seen most clearly in FIGS. 2 and 3, while the boom is being lowered the weight of the boom acting on the linkage tends to rotate the side plates 42 and 43 in a clockwise direction (as viewed in FIG. 2) around the pin 45. This forces the base plate 41 upwardly against the lower end of the spring 40 to compress the spring. In this condition, the spring 41 forms a resilient connection between the boom 10 and the actuator 30, biasing the side plates 42 and 43 of the linkage in a counterclockwise direction as viewed in FIG. 2, i.e., counter to the force applied to the linkage by the weight of the boom and in opposition to the retracting movement of the piston rod 32. Consequently, if the boom 10 suddenly strikes a rigid object, for example, the actuator is free to continue to move downwardly against the force of the spring 40 and away from the boom 10 until the spring 40 has been fully compressed. Thus, the effect of the spring is to permit the downward movement of the actuator to be stopped gradually, rather than abruptly, thereby reducing the resultant strain on the actuator and the hydraulic lines and valves associated therewith.

When the boom is resting on a rigid support, such as the saddle 18 shown in FIG. 1 or the ground support 20 shown in FIG. 5, the operation of the spring 40 is the same as that described above during lowering movement of the boom. Whenever the boom is supported by one of these rigid structures, the hydraulic actuator is retracted slightly to partially compress the spring 40, as illustrated in FIGS. 1 and 5, thereby forming a resilient connection between the boom 10 and the actuator 30 with the spring 40 biasing the linkage in a counterclockwise direction. Consequently, if the derrick is subjected to a sudden force which causes relative movement between the boom 10 and the actuator 30, such as flexing of the frame of the truck 14, such relative movement is initially taken up by the spring 40 until it reaches its fully compressed condition. Thus, the forces applied to the hydraulic actuator 30, as well as the other portions of the derrick, are gradual rather than sudden, thereby reducing the strain on all of these elements.

During upward movement of the boom 10 in response to advancing movement of the piston rod 32 of the actuator 30, the force of the actuator turns the side plates 42 and 43 of the linkage in a counterclockwise direction around the upper pin 44 until the top edges **42*a* and 43*a* of the plates engage the underside of the boom 10. This forms a rigid connection between the boom 10 and the actuator 30** as long as sufficient force is applied to the linkage by the hydraulic actuator. This rigid connection is desirable during upward movement of the boom because it is unlikely that the derrick will be subjected to any sudden forces during such upward movement.

While the invention has been described with specific reference to the use of the linkage between the boom and the actuator, it will be understood that a similar linkage could be provided at the lower end of the boom where it is connected to the clevis frame 11. This lower linkage could be in addition to or in place of the upper linkage that is shown in the drawings.

As can be seen from the foregoing detailed description, this invention provides an improved actuator linkage which reduces the strains on the actuator due to flexing of the vehicle from or sudden contacts of the boom with the ground or other rigid objects. The linkage thus extends the operating life of the actuator and also reduces maintenance problems. The resilient linkage reduces strains on the structural elements of the derrick, and also reduces the strain on the derrick boom due to sinking or downward movement of the boom saddle or other rigid support between the operative end of the actuator and the free end of the boom. Moreover, the structure of this improved actuator linkage is simple and economical to manufacture and is sufficiently rugged that it has a long operating life.

I claim as my invention:

1. In a vehicle, a mobile derrick having a boom pivotally mounted at one end on said vehicle and a hydraulic actuator also pivotally mounted at one end on said vehicle for raising and lowering the boom, the improvement comprising a linkage interconnecting the other end of said hydraulic actuator with said boom while permitting limited relative movement between the interconnected points of the boom and the actuator, first pivot means for connecting said linkage to said actuator, and second pivot means for mounting said linkage to said boom, said first and second pivot means being spaced apart such that said linkage is selectively engageable with said boom upon moving said actuator in a predetermined direction, and resilient biasing means connected to said linkage and resisting downward movement of the actuator away from the boom, said linkage being responsive to upward movement of the actuator to form a rigid connection between the boom and the actuator and bypassing said biasing means, and responsive to downward movement of the actuator to form a resilient connection between the boom and the actuator through said biasing means to permit limited downward movement of the actuator away from the boom against the urging of said resilient biasing means.

2. A vehicle, a mobile derrick having an actuator linkage as set forth in claim 1 wherein said linkage comprises a rigid member pivotally connected to said boom and to said actuator, and said resilient biasing means urges said rigid member around said pivotal connections in the same direction as advancing movement of said actuator, said rigid member including means for limiting the movement thereof around said pivotal connections in response to advancing movement of said actuator. .

3. A vehicle, a mobile derrick having an actuator linkage as set forth in claim 1 wherein said resilient biasing means comprises a compressed coil spring.

4. A vehicle, a mobile derrick having an actuator linkage as set forth in claim 2 wherein said resilient biasing means comprises a compressed coil spring disposed between said boom and said rigid member.

5. A vehicle, a mobile derrick as set forth in claim 4 wherein said spring is positioned to be compressed in response to retracting movement of said actuator relative to said boom.

6. In a vehicle, a mobile derrick having a bottom pivotally mounted at one end on said vehicle and a hydraulic actuator also pivotally mounted at one end on said vehicle for raising and lowering the boom, the improvement comprising a linkage interconnecting the other end of said hydraulic actuator with said boom while permitting limited relative movement between the interconnected points of the boom and the actuator, first pivot means for connecting said linkage to said actuator, and second pivot means for mounting said linkage to said boom, said first and second pivot means being spaced apart such that said linkage is selectively engageable with said boom upon moving said actuator in a predetermined direction, and resilient biasing means connected to said linkage and urging the boom away from the actuator, said linkage being responsive to upward movement of the actuator to form a rigid connection between the boom and the actuator and bypassing said biasing means, and responsive to movement of the boom toward the actuator to form a resilient connection between the boom and the actuator through said biasing means to permit limited movement of the boom toward the actuator against the urging of said resilient biasing means.

7. A vehicle, a mobile derrick having an actuator linkage as set forth in claim 6 wherein said linkage comprises a rigid member pivotally connected to said boom and to said actuator, and said resilient biasing means urges said rigid member around said pivotal connections in the same direction as advancing movement of said actuator, said rigid member including means for limiting the movement thereof around said pivotal connections in response to advancing movement of said actuator.

8. A vehicle, a mobile derrick having an actuator linkage as set forth in claim 6 wherein said resilient biasing means comprises a compressed coil spring.

9. A vehicle, a mobile derrick having an actuator linkage as set forth in claim 7 wherein said resilient biasing means comprises a compressed coil spring disposed between said boom and said rigid member.

10. A vehicle, a mobile derrick as set forth in claim 9 wherein said spring is positioned to be compressed in response to retracting movement of said actuator relative to said boom.

11. In a vehicle, a mobile derrick having a boom pivotally mounted on said vehicle and a hydraulic actuator pivotally connected to the vehicle for raising and lowering the boom, the improvement comprising linkage between the actuator and the boom comprising a rigid member pivotally connected to both the boom and the actuator to permit limited relative movement between the interconnected points of the boom and the actuator, first pivot means for connecting said linkage to said actuator, and second pivot means mounting said linkage to said boom, said first and second pivot means being spaced apart such that said linkage is selectively engageable with said boom upon moving said actuator in a predetermined direction, and resilient biasing means connected between said rigid member and said boom for urging said rigid member in the same direction as raising movement of the actuator so that downward movement of the boom is resisted by said biasing means.

* * * * *